United States Patent [19]

Hülsmann

[11] Patent Number: 4,760,808

[45] Date of Patent: Aug. 2, 1988

[54] DEVICE AND METHOD FOR FORMING A PIPED OPENING IN A GARMENT

[75] Inventor: Norbert Hülsmann, VS-Schwenningen, Fed. Rep. of Germany

[73] Assignee: Beisler GmbH, Fed. Rep. of Germany

[21] Appl. No.: 903,269

[22] Filed: Sep. 3, 1986

[30] Foreign Application Priority Data

Sep. 6, 1985 [DE] Fed. Rep. of Germany ..... 3531895

[51] Int. Cl.[4] ..... D05B 3/10

[52] U.S. Cl. ..... 112/68; 83/175; 83/902; 112/104; 112/121.26; 112/289

[58] Field of Search ..... 83/175, 176, 902, 471.1, 83/471.2, 477.2, 374, 423, 451, 563; 112/65, 68, 121.26, 121.27, 104, 289, 296, 298

[56] References Cited

U.S. PATENT DOCUMENTS

| | | | |
|---|---|---|---|
| 2,529,072 | 11/1950 | Bradford et al. | 112/68 |
| 3,170,349 | 2/1965 | Weinkle | 83/175 |
| 3,565,732 | 2/1971 | Colianni | 112/68 |
| 3,980,030 | 9/1976 | Fischer et al. | 112/65 |
| 4,034,689 | 7/1977 | Hintzer et al. | 112/68 |
| 4,502,356 | 3/1985 | Dietrich et al. | 83/175 |

FOREIGN PATENT DOCUMENTS

| | | | |
|---|---|---|---|
| 1934900 | 1/1971 | Fed. Rep. of Germany | 112/68 |
| 60-40312 | 9/1985 | Japan | 112/68 |

*Primary Examiner*—E. R. Kazenske
*Assistant Examiner*—Hien H. Phan
*Attorney, Agent, or Firm*—Harness, Dickey & Pierce

[57] ABSTRACT

Apparatus and a method for making a piped opening in a garment are disclosed. Two collinear cuts are made in the piping strip at a preparation station. The cut piping strip is then transferred to a sewing machine table where the piping is laid onto a piece of fabric. Then, the incision for making the garment opening is cut through both the piping strip and fabric. The piping strip is then folded through the incision and the two collinear cuts in the piping cooperate to prevent bulges from forming in the ultimately formed piped opening in the garment.

7 Claims, 3 Drawing Sheets

DEVICE AND METHOD FOR FORMING A PIPED OPENING IN A GARMENT

The invention concerns a device for transference of a piping strip from a preparation station to a piece of fabric, which lies on a sewing machine table. The invention includes a stationary support plate for the piping strip and a piping receiver. The piping receiver comprises a shape bar and a gripping mechanism. The piping receiver is movable between a piping delivery position and a piping receiving position. In its receiving position, the piping receiver is lowered with its shape bar onto the support plate.

A device of the aforementioned sort is, for example, established in the German Utility Model 75 25743. The piping strip arranged on the support plate is transferred by the piping receiver onto the piece of fabric. The piping is then folded around the shape bar. Subsequently, a two-needled sewing machine sews it onto the fabric. During the sewing procedure a knife produces a pocket incision between the seams. After the seams are finished, a V-shaped angular cut or gore cut is produced on each end of the pocket incision. After the piping has been sewn on, the end portions of the piping and its edges parallel to the seams are folded through the pocket incisions to the inside of the fabric. By doing this, only the piped pocket openings are visible on the outer (right) side of the fabric. By turning the piping inside out, folds form on the ends of the pocket incision, on which three layers of piping lie. The piping ends are therefore not only bulky, but also produce a noticeable bulge, especially when somewhat thicker material is used. For this reason, the ends of the piping strip must be generally cut by hand in alignment or collinearly with the pocket incision, in a separate process. In mass clothing production, it is often necessary to engage manual labor solely for the purpose of cutting the piping after folding them through the pocket incisions.

It is one object of the invention to provide a device of the aforementioned sort that will eliminate the additional work process after the piping has been sewn on by making the two collinear cuts automatically at a preparation station before the piping is transferred to the sewing station where the piping is later sewn onto the fabric and the pocket incision made.

This object will be solved according to the invention by forming a groove- or slit-shaped recess in the shape bar's underside facing the support plate, the slit-shaped recess being parallel to the longitudinal direction of the shape bar, and by a cutting mechanism having at least one knife and being arranged on the support plate in such a way that during the cutting process, the knife engages into the recess of the shape bar on the piping receiver, while the same is in its receiving position.

With the device according to the invention, it is possible to cut a piping strip before it is folded and sewn onto the fabric. However, the cutting is performed after the piping receiver has been put onto the piping strip. Therefore, the position of the piping strip relative to the piping receiver cannot change after formation of the wo collinear cuts in the piping. Thus, it is insured that the cuts on the piping's end portions will be in exact alignment with the pocket incision which is to be cut later, and that they will lie exactly in the middle between the seams to be sewn. To cut the piping before its seizure by the piping receiver would, in practice, lead to almost insurmountable problems. It would be necessary to arrange the piping in a very exact position relative to the piping receiver, while same is in its receiving position to be sure that the seams and the pocket incision were both in the desired position relative to the existing cuts in the piping.

Preferably, the cutting mechanism has two knives which are movable in opposite directions. These knives may be mounted each, for example, to a carriage on the underside of the support plate. The carriages are movable parallel to the shape bar's longitudinal direction. These knives project through a slit in the support plate. Movement of the carriage can either be achieved by a threaded shaft drive, or by means of a pressure-activated cylinder. The knives are preferably formed by rotary disk knives, which are each driven by a motor attached to the carriage.

Further characteristics and advantages of the invention are given in the following description in connection with the attached drawings which show an embodiment of the invention.

Figure 1:
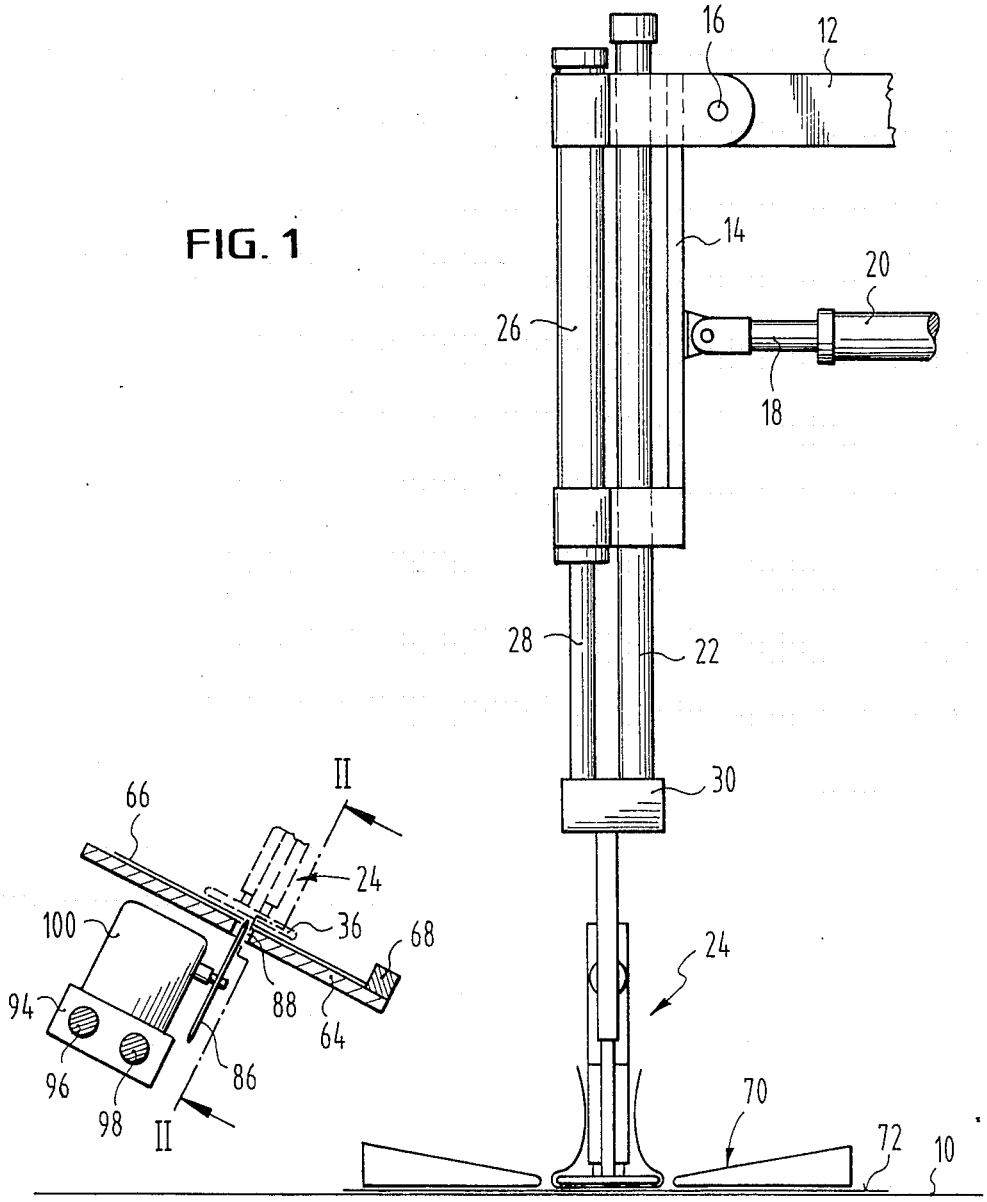
FIG. 1 shows a schematic view of the piping receiver and the support plate as viewed in the transport direction of the fabric during the sewing process.

In FIG. 1, above a sewing machine table 10, a frame 14 is mounted on a frame stand 12 such that it is pivotable about a swivel axle 16. This frame stand 12 is stationary on the table or sewing machine. The piston rod 18 of a pressure operated cylinder 20 is connected to the swivel frame 14. The cylinder 20 is pivotally mounted on the frame stand 12 on the sewing machine table. With help of the cylinder 20 the swivel frame 14 may be pivoted about its pivotal axle 16.

A piping receiver, generally referred to here as 24, is vertically shiftable in the swivel frame 14 by means of two guiding rods 22, which in view of FIG. 1, lie behind each other. A cylinder 26 serves to vertically move the piping receiver 24. The cylinder 26 is fastened to the swivel frame 14 and its piston rod 28 is connected to a connecting piece 30 which connects the guiding rods 22 and the piping receiver 24.

Figure 2:
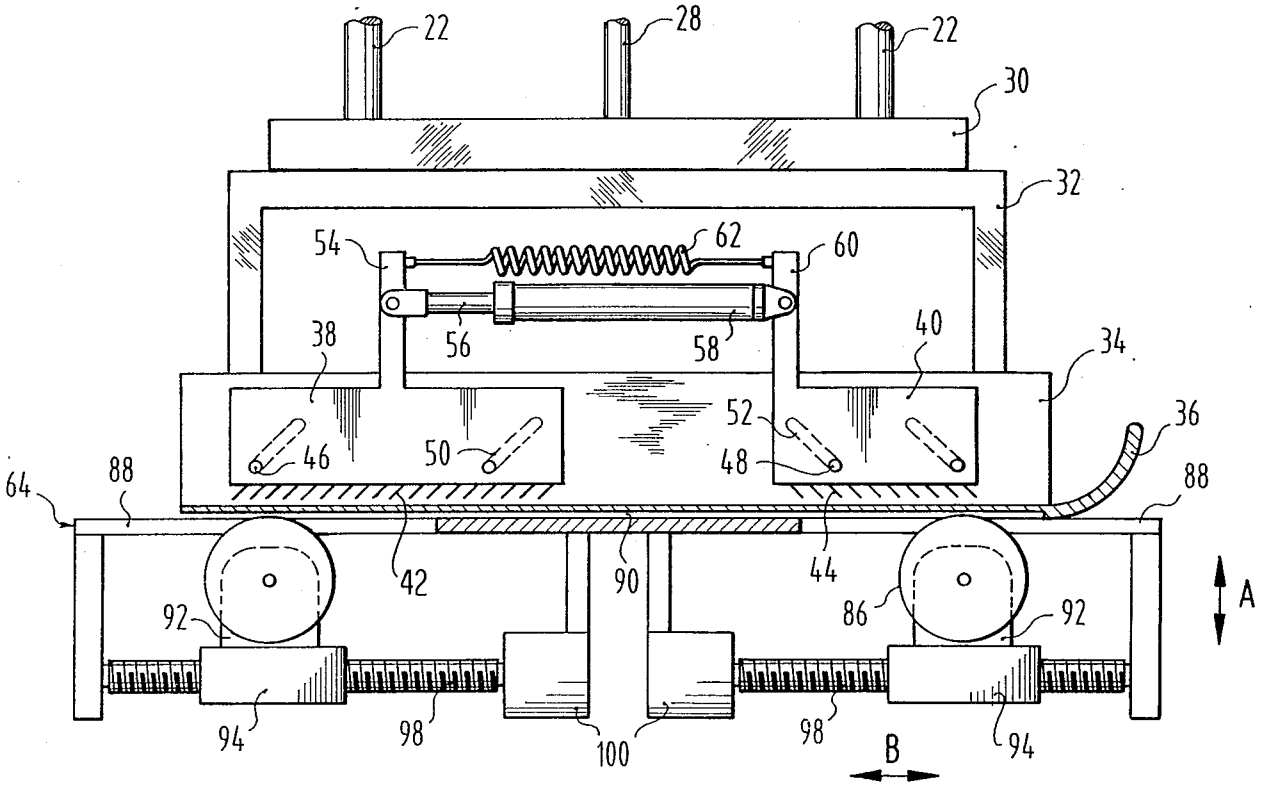
FIG. 2 shows a schematic partial cross-section along the lines II—II in FIG. 1.

As shown in FIG. 2, the preferred piping receiver 24 includes a C-shaped bow 32, which is attached to the connecting piece 30. A flat center bar 34 is affixed to the free ends of this bow 32. A shape bar 36 is attached to the horizontal edge (facing away from the bow 32) of the center bar 34, the shape bar being situated in a plane which is perpendicular to the plane of the center bar 34. On its free end, this shape bar 36 is curved upward, in the manner depicted in FIG. 2. Together, the center bar 34 and the shape bar 36 resemble an upside-down T, as can be seen in FIG. 1.

Two plate-shaped needle carriers 38 and 40 are arranged on either side of the center bar 34. On their lower horizontal edges, these needle carriers 38 and 40 each carry gripping needles 42 and 44. These gripping needles 42, 44 are each tilted towards the surface of the shape bar 36. The tilt of the gripping needles 42 on the needle carrier 38 is opposite to the tilt of the gripping needles 44 on the needle carriers 40. The needle carriers 38 and 40, respectively, on both sides of the center bar 34, are each connected by a pair of pegs 46 and 48, respectively. These pegs 46 and 48 are guided in slots 50 and 52, respectively, formed in the center bar 34. The longitudinal axes of the slots 50 and 52 are directed parallel to the gripping needles 42 and 44. Each needle carrier 38 is flexibly connected to the piston rod 56 of a cylinder 58 by a projection 54. The cylinder 58, on its opposite side, is flexibly connected to the needle carrier 40 through the projection 60. A tension spring 62 is stretched between the projections 54 and 60, which spring normally moves the needle carriers 38 and 40 toward each other. Because of the slanting slots 50 and 52, the needle carriers 38 and 40 are held in the above position, in which the gripping needles 42 are, above the shape bar 36. If pressure is admitted to the cylinder 58, the needle carriers 38 and 40 are pushed away from each other. Then, because they are guided in the slanted slots 50 and 52, they will be moved at the same time in the direction of the shape bar 36. Then the gripping needles 42 merge downwards through slits in the shape bar 36, not illustrated here, so that they may penetrate into the piping strip which lies underneath the shape bar 36.

The conventional use of the piping receiver to form a piped opening such as a pocket will be described briefly. A piping strip 66 is arranged by hand on a support plate 64 which is fastened to the frame stand 12, and is inclined relative to the sewing table 10. With help of a stop ledge 68, on the support plate 64, the piping 66 is aligned. With help of the cylinder 26 (in FIG. 1), the piping receiver 24 is moved vertically upwards. Then the swivel frame 14 swings to the left (in FIG. 4) by means of the cylinder 20. In this way, the piping receiver 24 shifts to the position above the support plate 64, as indicated by dotted lines. Then the piping receiver 24 and the shape bar 36 will be lowered onto the piping strip 66 by the cylinder 26. The piping 66 is then seized in the above described manner by the gripping needles 42 and 44. After the piping receiver 24 has been lifted and swung back, the piping 66 is placed between the legs of a schematically indicated fabric clamp 70, which holds a fabric 72 to the sewing machine table 10. Then, the piping strip 66 is folded around the frame bar 36 in the manner illustrated in FIG. 1 with help of a folding element, which is not represented here, so that the piping 66 lies with both its edge segments on the center bar 34. By means of clamp elements (not represented here) on the fabric clamp 70, the piping strip 66 will be held in the folded position.

Figure 3:
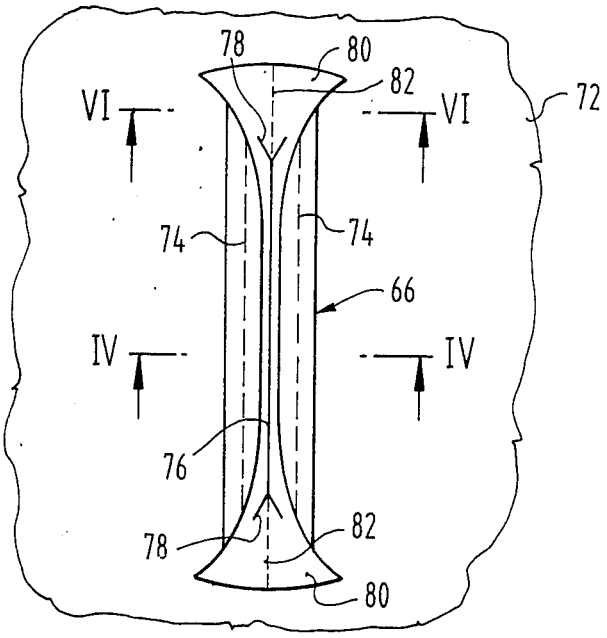
FIG. 3 shows a top view of the piping on the fabric after completion of the sewing process.
Figure 4:
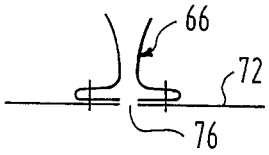
FIG. 4 shows a schematic sectional view along the lines IV—IV in FIG. 3.
Figure 5:
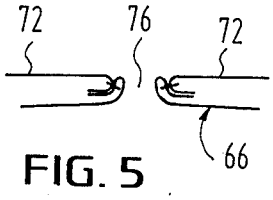
FIG. 5 shows a schematic section corresponding to FIG. 4, after the piping has been turned inside out.
Figure 6:
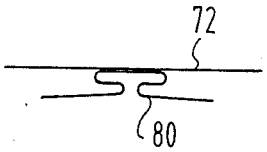
FIG. 6 shows a schematic sectional view along the lines IV—IV in FIG. 3, through the fabric and the piping (after it has been turned inside out), although the free ends of the piping strip have not been cut.
Figure 7:
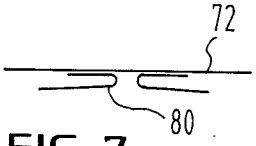
FIG. 7 shows a sectional view similar to FIG. 6, showing the horizontal ends of the piping cut.

After the piping receiver 24 is removed, the piping 66 is sewn onto the fabric 72 by a two-needled sewing machine. At the same time, a slit or incision directed parallel to the seams 74 (FIG. 3) and angular V-shaped cuts 78 are produced on the longitudinal ends of the incision in the fabric and piping. FIGS. 3 and 4 show the piping strip 66 and the fabric 72 after completion of the sewing process. Then, the ends 80 of the piping are folded through the incision 76. The piping 66 is turned in this manner, resulting in the configuration schematically illustrated in FIG. 5 for the area of the incision 76. In the area of the ends 80 of the piping strip, the resulting situation is schematically illustrated in FIG. 6. One can see that the three layers of piping in the area of its free ends 80 can lead to a cumbersome bulge. The end segments 80 are usually then cut by hand along the dotted line 82 drawn in FIG. 3. This then yields the result illustrated in FIG. 7 in the area of the piping ends after the piping has been turned.

According to the present invention the two collinear cuts 82 are automatically cut at the preparation station before the piping 66 is transferred to the sewing machine table 10 for the aforementioned conventional processing. To avoid cutting the piping by hand, and the disadvantages of doing so, two rotary knives 86 are situated under the support plate 64. These knives 86 each project through a slit 88 in the support plate 64. The slits 88 are in alignment with each other and with the center bar 34 of the piping receiver 24, when same is in its receiving position on the support plate 64. A slit-shaped recess 90 is provided in the shape bar 36, between the openings through which the gripping needles 42 and 44 can penetrate. The recess 90 lies exactly over the slits 88 in the support plate 64, when the piping receiver is in its receiving position above the support plate 64. In this way, the knives 86 which penetrate through the slit 88 also project into the recess 90 of shape bar 36 by a small amount so that a complete cut of the piping 66 along the cutting line 82 is insured.

The rotary knives 86 are each driven by a motor 92. These motors 92 are arranged on sliding carriages 94 preferably such that they are moveable (not represented here) vertically in the direction of the double arrow A towards the support plate 64. The sliding carriages 94 are mounted on a guiding rod 96 which is parallel to the support plate 64 and on a screw-threaded shaft 98 parallel to the guiding rod 96. A motor 100 drives the screw-threaded shaft 98. With help of this shaft 98, the sliding carriage 94 may be moved in the direction of the double arrow B, parallel to the support plate 64. The guiding rods 96, the screw-threaded shafts 98 and the motors 100 are all suitably fastened to the underside of the support plate 64. The control of both motors 100 appropriately results in the two rotary knives 86 being moved in opposite directions.

According to the invention the piping strip 66 is laid onto the support plate 64 in the above described conventional manner, so that the piping 66 lies with its edges on the stop ledge 68. Then the piping receiver 24 is laid onto the piping strip 66. The piping 66 is then seized by the gripping needles 42 and 44, stretched, and held securely to the support plate 64. Then the end segment 80 of the piping will be cut along the cutting line 82 (FIG. 3) by adjusting the driven rotary knives 86 in the direction of the arrow B. As can be seen best in FIG. 3, the cutting lines 82 produce two collinear cuts on the outer edges of piping strip 66. The piping 66 which has been cut in this way does not then change its location relative to the piping receiver 24. The piping 66 is now ready to be processed in the conventional manner described above. After the piping 66 has been sewn onto the fabric 72 and the incision 76 made, it is no longer necessary to cut the piping's end segment for it to be easily turned since this has already been done at the preparation station. Thus, the piping's end segments also have the form represented in FIG. 7.

The cutting mechanism according to the invention is not limited to the employment of rotary knives. Blades which move back and forth may, for example, also be used.

I claim:

1. In an apparatus for making a piped opening in a garment where a piping strip is transferred from a preparation station onto a piece of fabric lying on a table of a sewing machine, the improvement comprising:

said preparation station including cutting means for forming first and second collinear cuts in the piping strip, said first cut extending from a first point and running outwardly to an edge of the strip, and said second cut extending from a second point outwardly to an opposite edge of the piping strip; and receiving means for holding the piping strip in the preparation station while the collinear cuts are made and for transferring the cut strip onto said fabric lying on the table whereby an incision for a garment opening can be made between the first and second points through both the piping strip and fabric, with the piping being subsequently pulled through the incision to form a piped opening in the garment.

2. The improvement of claim 1 wherein said receiving means includes a shape bar having a recess on the underside thereof, and wherein said cutting means includes a knife mechanism located beneath the shape bar at the preparation station, the knife mechanism entering the recess in the shape bar while making the two collinear cuts in the piping strip, while the shape bar is holding the strip in place.

3. The improvement of claim 2 wherein the knife mechanism includes two knives and means for moving the knives along a collinear path to make the two cuts.

4. The improvement of claim 3 wherein said two knives counterrotate with respect to each other.

5. The improvement of claim 4 wherein the two knives are mounted on a sliding carriage.

6. The improvement of claim 5 wherein said sliding carriage is driven by a shaft drive mechanism.

7. The improvement of claim 2 wherein said receiving means includes two rows of gripping needles parallel to one another, and wherein said recess in the shape bar is located along the horizontal center line thereof between said rows of gripping needles.

* * * * *